United States Patent [19]

Smith et al.

[11] Patent Number: 4,557,733

[45] Date of Patent: Dec. 10, 1985

[54] FORMCOKE PROCESS

[75] Inventors: Jimmy B. Smith; Julian M. Liggett, both of Columbia, Tenn.

[73] Assignee: Peabody Development Company, St. Louis, Mo.

[21] Appl. No.: 667,974

[22] Filed: Nov. 5, 1984

[51] Int. Cl.[4] ..... C10L 5/04; C10L 5/16; C10L 5/28; C10L 5/30

[52] U.S. Cl. ..... 44/10 C; 44/10 R; 44/15 R; 44/19; 201/6; 201/8; 201/22; 201/24; 201/28

[58] Field of Search ..... 44/10 C, 10 R, 15 R, 44/19; 201/6, 8, 24, 28, 22, 15, 39

[56] References Cited

U.S. PATENT DOCUMENTS 3,140,241 7/1964 Work et al. ..... 44/23
3,140,242 7/1964 Work et al. ..... 44/23
3,619,148 11/1971 Wilde et al. ..... 44/10 C
3,969,088 7/1976 Mansfield et al. ..... 44/19
4,156,595 5/1979 Scott et al. ..... 44/10 C

FOREIGN PATENT DOCUMENTS 2211371 3/1972 Fed. Rep. of Germany ..... 44/10 C

*Primary Examiner*—D. E. Gantz
*Assistant Examiner*—Chung K. Pak
*Attorney, Agent, or Firm*—Littlepage & Webner

[57] ABSTRACT

Green coal is charred in pre- and post- treatment carbonizers, then crushed, mixed with pitch, briquetted, tempered in a tempering oven, recirculated with succeeding green coal to char in a reducing atmosphere through only the latter part of the pre-treatment carbonizer and through the post-treatment carbonizer, cooled, and separated from the as yet unbriquetted char. The pre-treatment carbonization is characterized by having air updrafted through all the airbox zones under the travelling grate.

7 Claims, 2 Drawing Figures

FORMCOKE PROCESS

PRIOR ART

Mansfield, U.S. Pat. No. 3,969,088; Scott, U.S. Pat. No. 4,156,595; Work, U.S. Pat. No. 3,140,241 and 3,140,242.

BACKGROUND OF THE INVENTION

This process is an improvement over that disclosed in Mansfield U.S. Pat. No. 3,969,088 wherein sized green coal starting material is devolatilized by successively passing it through a horizontal chain grate pre-carbonizer furnace having a zoned airbox, and a shaft furnace, i.e., a soaking pit, then crushed and mixed with pitch binder, formed into green briquettes, and then recirculated with the green coal starting material through the pre-carbonizer furnace. In that process the green briquettes were cured in the oxidizing atmosphere of the pre-carbonizer furnace simultaneously with the partial devolatilization of the green coal starting material. Also, in that process, the pitch binder was obtained by downdrafting the first few airbox zones so as to pull off the low temperature volatiles, and then condensing them. In the subject process, however, the green briquettes are tempered prior to recycling through the pre-carbonizer furnace with the incoming green coal and they are imposed as an overburden onto the green coal bed at a point downstream from where it is introduced onto the chain grate. A somewhat comparable formcoke process, without the tempering step, is disclosed in Scott et al. U.S. Pat. No. 4,156,595.

OBJECTS OF THE INVENTION

The object of the invention is to produce formcoke briquettes of improved strength and hardness, suitable for blast furnace and foundry use, in a substantially closed system by a method having improved running and maintenance conditions, with less likelihood of the occurrence of explosions.

SUMMARY OF THE INVENTION

As will be detailed hereinafter, several advantages are obtained including closer process control, full-hardening of the briquettes before re-introduction into the pre-carbonizer furnace, near complete devolatilization of the briquettes prior to recirculation through the pre-carbonizer furnace, and enhancement of the coking or charring of the green coal as a result of the overburdening of the cured briquettes onto it after it has been fully ignited and passed partway through the pre-carbonizer furnace.

In the improved formcoke process of this invention, a tempering oven is used to harden the green briquettes and to remove the low temperature volatiles from them before recycling through the latter part of a pre-treatment carbonizer and through a shaft furnace. The briquettes are tempered in a tempering oven, which increases their strength before they enter the pre-treatment carbonizer and are deposited as an overburden on top of the green coal partway along the travelling grate. The low temperature volatiles emitted from the briquettes in the tempering oven enter the system at approximately the same point as the briquettes, and form a reducing atmosphere above the layer of tempered green briquettes which have been deposited on the already ignited green coal. The amount of air updrafted is controlled so that the green coal is controlledly charred in an oxidizing atmosphere but the layer of tempered green briquettes deposited on top of the green coal is carbonized in a reducing atmosphere present above the grate. If too much air is updrafted, the lower surfaces of the layer of briquettes will be oxidized. If insufficient air is updrafted, the green coal will be insufficiently charred or coked. The controlled process of this invention produces briquettes of increased strength and hardness. Furthermore, the presence of the briquettes overlaying the layer of green coal serves to increase the density, and thus increase the strength, of the green coal as it passes through the pre-treatment carbonizer.

The green coal on the travelling grate must be fully ignited before the briquettes are added on top of the coal and this ignition occurs over the first few airbox zones in the oxidizing updraft before the briquettes are added.

The process may be practiced using any type of coal including lignite, bituminous coal, anthracite, etc. Choice of coal may be determined by the end use of the briquettes, for example, steel industry specifications require use of coal having relatively low ash and low sulfur content.

DESCRIPTION OF THE PREFERRED EMBODIMENTS

Figure 1:
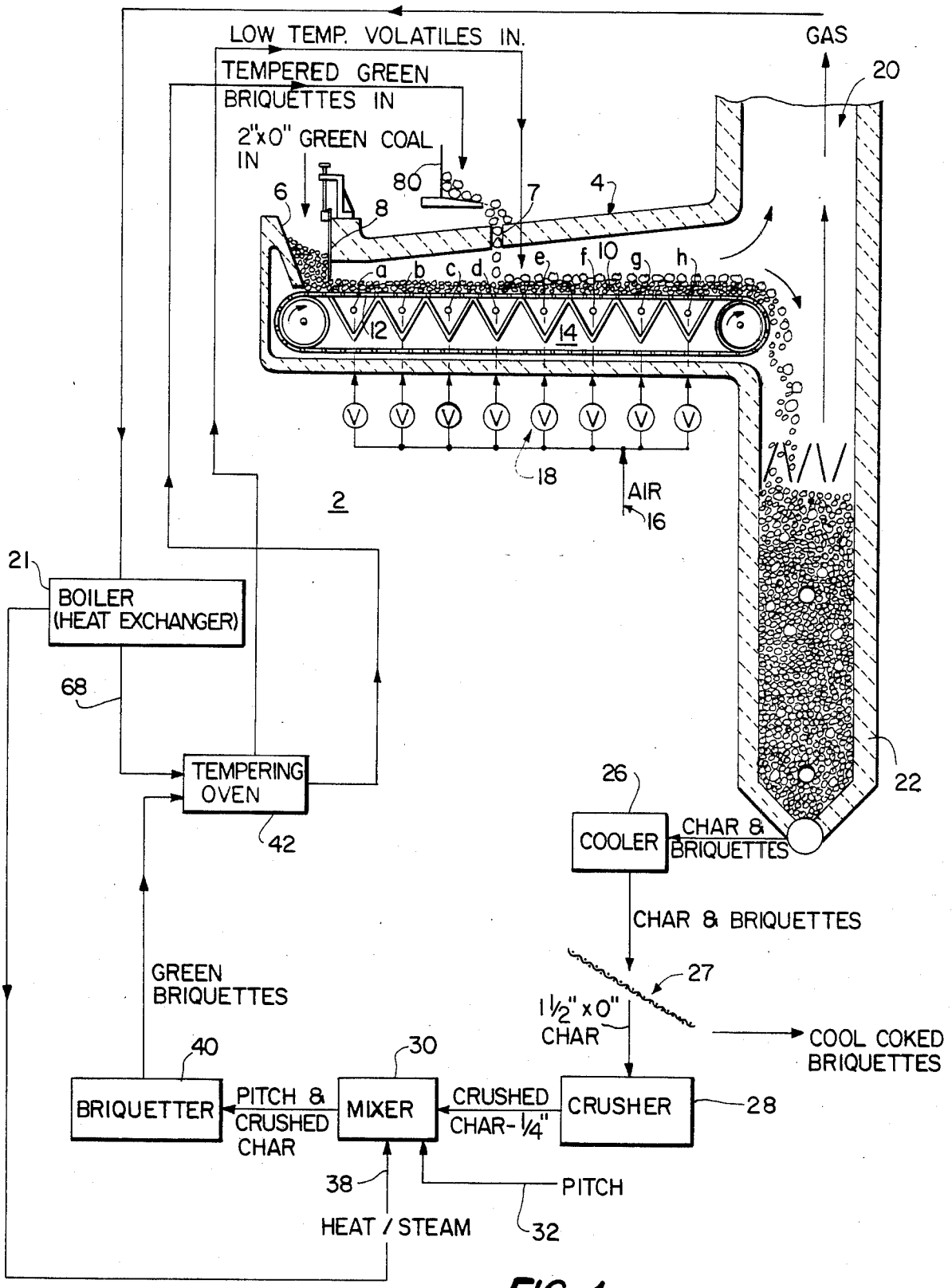
FIG. 1 is a diagram of the apparatus used in the improved formcoke process of the invention.

FIG. 1 shows an apparatus 2 suitable for practicing the process of present invention. The pre-treatment carbonizer 4 has an input, for example a hopper 6, to which green coal preferably sized 2×0 inch, with a maximum of about 40% minus ¼ inch, is charged, and then spread by gate 8 to form bed 10 on the continuously moving chain grate 12. Beneath the chain grate is a zoned airbox 14 having, for example, eight zones a to h inclusive, all of which are supplied with updrafted air, preferably at ambient temperature, from an air supply 16 in amounts which are carefully controlled and limited by valves 18. About 1 to 3 lb. air per lb. of green coal is used. Tempered green briquettes which have been hardened in tempering oven 42 enter the furnace downstream of the entry of the green coal, for example oven airbox zones c or d. Appropriate methods of allowing the briquettes to enter the furnace are such that only a minimal amount of air enters the furnace atmosphere with the tempered briquettes. For example, in a suitable method, the roof of furnace 4 has a series of window openings or portholes 7 approximately 4–8 ins. in diameter at 2–4 ft. intervals across its width through which the briquettes fall. The tempered briquettes fed from tempering oven 42 to hopper 80 fall through openings 7 to form an overburden of average depth 6–8 ins. on the bed 10 of ignited coal travelling on the grate. The tempered briquettes should be distributed evenly to the openings 7. Exhaust gases from the system at a temperature of 1800°–2000° F. are taken off through stack 20. Stack 20 may supply gases to a boiler 21, or heat exchanger, whereby the temperature of the exhaust gases is reduced to 400°–500° F. for use in devolatilizing the briquettes in the tempering oven. From the output end of the chain grate 12, the material being treated falls into post-treatment carbonizer 22 which, in this instance, is a vertical shaft furnace having a reducing atmosphere, essentially a soaking pit, and from which, after a suitable residence time, the material exits to cooler 26 which may be a water quencher such as that disclosed in U.S. Pat. No. 4,409,067. At start-up, the exiting material consists of char, but as will be apparent hereinafter, the exiting material, after start-up, consists of char and post-treated briquettes which together pass from the post-treatment carbonizer 22 to cooler 26, where the material is cooled to 400° F. or less. From cooler 26 the char and briquettes move to a separator 27, for example, a screen from which the then cooled and fully coked briquettes which constitute the end product are taken. The char from which the fully coked briquettes have been separated moves from the size separator 27 to crusher 28 where it is sized to minus ¼ inch, and then to mixer 30 into which pitch from pitch supply 32 is fed. Steam from a suitable source 38 is also fed into mixer 30 and the fully mixed hot pitch and crushed char, then at from about 170° F. to 250° F., are fed to briquetter 40. The steam mixed in with the pitch and char strengthens the briquettes, both as to green strength and as to carbonized strength. The briquetter is preferably of the double roll type. Green briquettes are fed from briquetter 40 into tempering oven 42.

Figure 2:
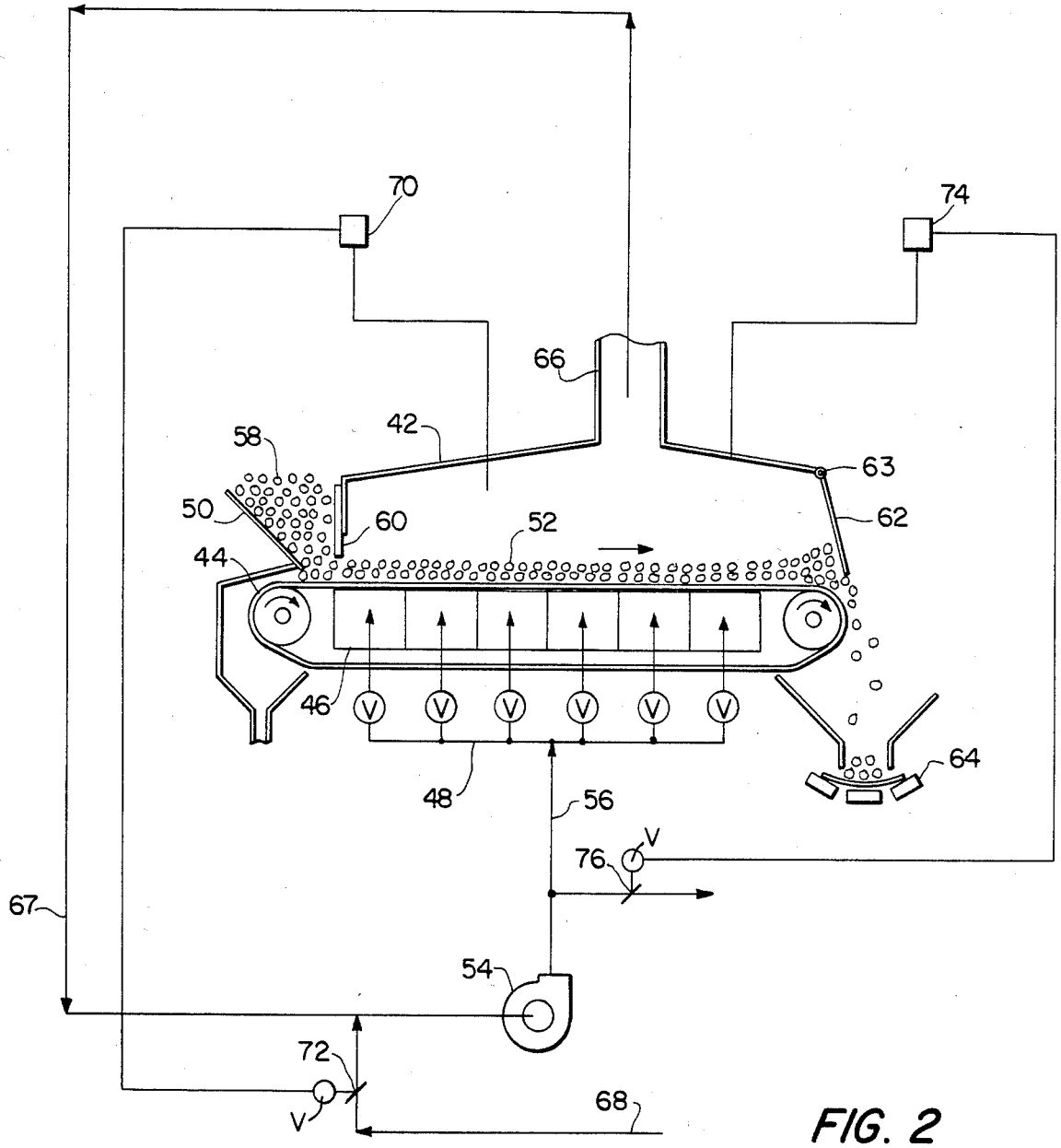
FIG. 2 is a diagram of the tempering oven used in the improved formcoke process of the invention.

Referring now to FIG. 2, the tempering oven 42 has running through it from to rear a perforate conveyor or chain grate 44. Between the upper and lower grate runs is a zoned gas box 46 having valve controlled input lines 48. Above the grate input is briquette hopper 50 from which the green briquettes 58 are deposited to form a bed 52. The gas which is used for tempering the briquettes is forced through the travelling briquette bed by the gas fan 54 by way of gas line 56, input lines 48 and zoned gas box 46.

In typical operation, briquettes 58, sized, for example, 2×2×1⅛ inch, are loaded into briquette hopper 50 from which a uniform briquette bed 52 is formed by the adjustable feed gate 60 with bed depth from 4 inches to 8 inches. The grate speed is regulated to allow for a briquette retention time of one to two hours. A flapper gate 62 is located at the discharge end of the oven to prevent an excessive amount of air from being pulled into the oven. Flapper gate 62 is hinged at 63 at the top and allowed to drag on the briquettes to maintain a good seal even if the bed depth is changed. Tempered briquettes are discharged from the tempering oven onto conveyor 64 and thence to hopper 80 (see FIG. 1) for input to the pre-treatment carbonizer 4 above airbox zones c or d.

The tempering gas after being forced through the briquette bed 52 is drawn from the oven by way of flue 66 and recirculated through line 67 and fan 54 through the system, as described above. Additionally, the hot gas is supplied to the tempering gas circuit by way of line 68. The gas used for tempering may be flue gas from the carbonizers. The gas in the tempering oven 42 is maintained at 400°±20° F. by temperature controller 70 which modulates damper 72 which controls the flow of hot gas into the tempering oven. The oven draft is controlled by pressure controller 74 which modulates damper 76 which controls the discharge of gas from the circuit. The discharged gas is combustible and may be used for steam generation, etc., or it may be recycled through the tempering oven by means of line 67.

It is important in the general operation of the tempering process to heat the green formcoke briquettes gradually and uniformly to a temperature that will drive off the low boiling volatile oils from the pitch binder. The temperature of the briquettes must be raised gradually to a temperature that is barely high enough to remove the volatile oils, in order to prevent the briquettes from disintegrating due to the rapid expulsion of the volatile oil vapors. It must also be accomplished at a uniform temperature to prevent the oil vapors from condensing on the cooler briquettes and dissolving them.

Several advantages over the prior art processes accrue from use of this improved process. Insertion of the tempering oven step as a pre-treatment of the briquettes allows the tempered briquettes to be added downstream of the entry point of the green coal in the pre-treatment carbonizer, for example, over airbox zones c or d in FIG. 1, and thus all the airbox zones can be updrafted. Furthermore, the briquettes are physically strengthened by the pre-tempering treatment. Other advantages accrue from this arrangement. When the green coal first reaches the travelling grate in the pre-treatment carbonizer the updrafted air allows the bed of green coal to ignite fully and carbonize in an oxidizing atmosphere. The tempered briquettes are added on top of the green coal when the bed of green coal is fully ignited, above under-grate airbox zones c or d, and at the same time, the low temperature volatiles from the tempering oven also enter the atmosphere above the travelling grate. The oxygen in the updraft air is limited so that it is fully consumed by the green coal, allowing the tempered briquettes on top of the coal to carbonize in a reducing atmosphere, further increasing their strength. Furthermore, the updrafted air is preferably at ambient temperature, needing no preheating, and this advantageously reduces the maintenance required to keep the travelling grate in running condition.

Another important advantage of this improved process using updrafted air through all the airbox zones is that the system is readily stabilized, creating a safer process environment by enabling greater control of the temperature and pressure in the essentially closed system.

Variations and modifications can be effected within the scope of the invention as described above, and as defined in the appended claims.

We claim:

1. A process for producing formcoke comprising igniting sized green coal, charring the ignited green coal and reducing the volatile content thereof by continuously feeding the same along a path through a pre-treatment carbonizer, said pre-treatment carbonizer being a static bed reactor having controlled amounts of air updrafted through the bed through airbox zones, to provide an oxidizing atmosphere in which the green coal is charred and a reducing atmosphere above the bed, further reducing the volatile content of the char by feeding the same through a post-treatment carbonizer having a reducing atmosphere, passing the char from the post-treatment carbonizer through a cooler, crushing the cooled char, mixing the crushed char with pitch, forming the mixture of crushed char and pitch into green briquettes, tempering the green briquettes by passing them through a tempering oven, adding the tempered briquettes from the tempering oven as an overburden on top of the ignited green coal part-way along the path through the pre-treatment carbonizer and thereby passing the added tempered briquettes through the reducing atmosphere on top of the bed of ignited green coal through the latter part of the path through the pre-treatment carbonizer, then through the post-treatment carbonizer and through the cooler, and separating the cooled briquettes from the char, wherein the briquettes are tempered in an inert atmosphere provided by exhaust gases recycled from the carbonizers, and the volatiles driven off from the briquettes during the tempering process are recycled into the atmosphere of the pre-treatment carbonizer.

2. The process of claim 1 wherein the static bed reactor is a horizontal chain-grate reactor.

3. The process of claim 1 wherein the post-treatment carbonizer is a shaft furnace.

4. The process of claim 1 wherein the briquettes are tempered in the tempering oven at about 400° F.

5. The process of claim 4 wherein the tempering oven has a bed depth of briquettes of between 4 inches and 8 inches.

6. The process of claim 4 wherein the briquettes are retained in the tempering oven between 1 and 2 hours.

7. A process for producing formcoke in pre-treatment and post-treatment carbonizers comprising passing undergrate air upwards through a bed of ignited green coal, reacting the air with volatiles in the coal, introducing an overburden of tempered briquettes onto the coal at a location where the oxygen in the updrafted air and the volatiles in the coal have substantially reacted together and a reducing atmosphere is provided above the bed, charring the tempered briquettes in the reducing atmosphere, and cooling and separating the briquettes from the charred coal wherein the briquettes are tempered in an inert atmosphere provided by exhaust gases recycled from the carbonizers, and volatiles driven off from the briquettes during the tempering process are recycled into the atmosphere of the pre-treatment carbonizer.

* * * * *